US006991139B2

(12) United States Patent
Garcia et al.

(10) Patent No.: US 6,991,139 B2
(45) Date of Patent: Jan. 31, 2006

(54) FLUID DISPENSER HEAD

(75) Inventors: Firmin Garcia, Evreux (FR); Gérard Cornet, Blaru (FR)

(73) Assignee: Valois Sas, Le Neubourg (FR)

( * ) Notice: Subject to any disclaimer, the term of this patent is extended or adjusted under 35 U.S.C. 154(b) by 54 days.

(21) Appl. No.: 10/885,716

(22) Filed: Jul. 8, 2004

(65) Prior Publication Data

US 2005/0006416 A1 Jan. 13, 2005

Related U.S. Application Data

(60) Provisional application No. 60/518,318, filed on Nov. 10, 2003.

(30) Foreign Application Priority Data

Jul. 10, 2003 (FR) ..... 03 08492

(51) Int. Cl.
*B65D 5/72* (2006.01)

(52) U.S. Cl. ..... 222/494

(58) Field of Classification Search ..... 222/321.1, 222/321.7, 321.9, 380, 402.1, 402.12, 402.13, 222/490, 491, 494
See application file for complete search history.

(56) References Cited

U.S. PATENT DOCUMENTS 2,913,749 A * 11/1959 Ayres ..... 401/196
3,428,223 A * 2/1969 Lewiecki et al. ..... 222/398
3,437,270 A * 4/1969 Venus, Jr. ..... 239/118
3,545,682 A * 12/1970 Beard ..... 239/469
4,989,790 A 2/1991 Martin et al.
5,186,368 A * 2/1993 Garcia ..... 222/490
5,271,533 A * 12/1993 Joulia ..... 222/402.13
5,617,978 A * 4/1997 Geier ..... 222/402.13
5,779,109 A 7/1998 Gueret
6,341,735 B1 * 1/2002 Baudin ..... 239/333
6,497,346 B1 * 12/2002 Dubois et al. ..... 222/494

FOREIGN PATENT DOCUMENTS

EP 0 864 371 A1 9/1998
JP 9-66958 A 3/1997

* cited by examiner

*Primary Examiner*—Philippe Derakshani
(74) *Attorney, Agent, or Firm*—Sughrue Mion, PLLC

(57) ABSTRACT

A fluid dispenser head comprising a body (1) forming a dispensing duct (14) having an outlet (143) defining an outlet axis X, and a shutter (2) fitted to the body (1) for the purpose of selectively closing off the dispensing duct (14) at its outlet (143), the shutter forming a dispensing orifice (22) that is closed in the absence of fluid under pressure in the dispensing duct, said shutter being provided with sealing means (24) and with fixing means (25*a*) co-operating respectively with complementary seal-receiving means (15) and with complementary holding means formed by the body (1), the fixing means comprising at least one fixing profile (253) facing radially outwards relative to the outlet axis X, and the holding means comprising at least one holding profile (193) facing radially inwards towards the outlet axis X.

17 Claims, 3 Drawing Sheets

FLUID DISPENSER HEAD

CROSS REFERENCE TO RELATED APPLICATION

This application claims the benefit under 35 U.S.C. §119 (e) of U.S. provisional patent application Ser. No. 60/518, 318, filed Nov. 10, 2003, now abandoned and priority under 35 U.S.C. §119(a)–(d) of French patent application No. FR-03.08492, filed Jul. 10, 2003.

TECHNICAL FIELD OF THE INVENTION

The present invention relates to a fluid dispenser head designed to be fitted to a fluid dispenser member such as a pump or a valve. The dispenser head may form a pusher on which the user can exert pressure for the purpose of actuating the dispenser member. However, this pusher function may be dissociated from the dispenser head. Such a dispenser head may, in particular, be used in association with a dispenser member for being fitted to a fluid reservoir in the fields of perfumes, cosmetics, or indeed pharmaceuticals.

BACKGROUND OF THE INVENTION

The type of fluid dispenser head of the present invention comprises, in general, a body forming a dispensing duct having an inlet designed to be connected to the dispenser head, and an outlet having an outlet axis X. The head further comprises a shutter fitted to the body for the purpose of selectively closing off the dispensing duct at its outlet, the shutter forming a dispensing orifice that is closed in the absence of fluid under pressure in the dispensing duct, and that is opened in the presence of fluid in the dispensing duct at a pressure greater than an opening threshold pressure, said shutter being provided with sealing means and with fixing means co-operating respectively with complementary seal-receiving means and with complementary holding means formed by the body for the purpose of fixing the shutter to the body in leaktight manner. The dispensing orifice is often formed merely by a single self-closing slit which remains leaktight and in the closed state in the rest position, i.e. in the absence of fluid at a pressure higher than the opening threshold pressure. A dispenser head of that type is already known from Document FR 2 654 078. The shutter in that document is snap-fastened to the body with a snap-fastening profile that faces inwards. In addition, the snap-fastening function and the sealing function almost coincide, or are at least very intimately associated with each other.

SUMMARY OF THE INVENTION

An object of the present invention is to define a dispenser head of that type that has improved sealing and fixing functions. In addition, the shutter and/or the body must be easy to mold and to remove from their molds. Permanent fixing is also another object. To achieve these objects, the present invention proposes, in one embodiment, for the fixing means to comprise at least one fixing profile facing radially outwards relative to the outlet axis X, and for the holding means to comprise at least one holding profile facing radially inwards towards the outlet axis X. This means that the shutter is fixed to the body over an outside periphery of the shutter and over an inside periphery of the body, unlike the fixing in the above-mentioned prior art dispenser head. According to another advantageous characteristic which may be implemented additionally or alternatively, the seal-receiving means are situated radially closer to the outlet axis X than the holding means. Advantageously, the seal-receiving means and the holding means extend substantially concentrically. This means that the fixing means are separated in space from the sealing means. In other words, the fixing means do not normally participate in sealing between the shutter and the body. Likewise, the sealing between the shutter and the body does not participate in fixing the shutter to the body. Thus, the sealing function and the fixing function are dissociated. It is thus possible to optimize each function (sealing and fixing) independently from each other. This does not apply to the prior art dispenser head in which the fixing participates in the sealing. Configuring the fixing profiles on the outside periphery of the shutter and separating the sealing function from the fixing function are two characteristics that can be implemented independently from each other.

According to another characteristic of the invention, the seal-receiving means comprise a peripheral groove which extends around the outlet, and the sealing means comprise a sealing lip in leaktight engagement in the groove. Advantageously, the groove forms two side walls interconnected by an end wall, the lip being in leaktight contact at least with the two side walls and advantageously also with the end wall. Preferably, the lip flanks an outlet chamber situated in alignment with the outlet of the duct and having a convergence wall which extends towards the dispensing orifice for the purpose of directing the pressurized fluid coming from the outlet towards the dispensing orifice. The sealing lip makes it possible to achieve a sealing quality that is particularly high, since the lip comes into leaktight contact with three distinct zones, namely the two side walls and the end wall. The sealing contact on the side walls is particularly effective since the two side walls face each other and the lip is thus compressed or wedged between said two side walls. Resistance of the lip to deformation is thus no longer a constraint. It is possible to form a lip that is very fine and that is inserted into a groove of very narrow width.

In another advantageous aspect of the invention, the fixing means comprise at least one fixing catch forming an outside fixing profile, and the holding means comprise at least one holding recess forming a holding profile designed to come into fixing engagement with the fixing profile. Advantageously, the holding means further comprise locking means designed to cooperate with the fixing means (catches) to lock the fixing profile in engagement with the holding profile. Preferably, the holding recess forms a locking surface designed to urge the fixing catch so as to push the fixing profile against the holding profile. In a practical embodiment, the locking surface faces radially outwards relative to the outlet axis X, the fixing catch forming a cam surface radially facing towards the outlet axis, said cam surface being in engagement with the locking surface. Also for practical reasons, the dispenser head has three fixing catches disposed on either side of and below the outlet axis X, when the inlet faces downwards.

Advantageously, said at least one holding recess comprises an insertion window defining an inner edge and an outer edge relative to the outlet axis, said outer edge defining a snap-fastening inside shoulder forming said holding profile, said outside fixing profile coming into snap-fastened engagement with said snap-fastening inside shoulder. The fixing catches with their outside fixing profiles thus extend around the sealing lip, and forming the fixing profiles on the outsides or on the outside peripheries of the catches also makes it possible for the shutter to be removed naturally from the mold by moving the mold portions apart. This does not apply when the fixing profiles are provided on an inside wall or face towards the outlet axis. In which case, the shutter is removed from the mold by applying force, which often damages the fixing profiles. The resulting fixing quality is lower. As for the locking means, they guarantee that the locking profiles are fixed irreversibly or in tamper-proof manner to the holding profiles.

According to another characteristic of the invention, the dispensing orifice is a self-closing slit urged at rest into a leaktight closed position. This slit may be formed merely by making a single incision in the shutter by means of a cutting blade.

BRIEF DESCRIPTION OF THE DRAWINGS

The invention is described more fully below with reference to the accompanying drawings which show an embodiment of the invention by way of non-limiting example.

In the figures.

DETAILED DESCRIPTION OF THE INVENTION

Figure 1:
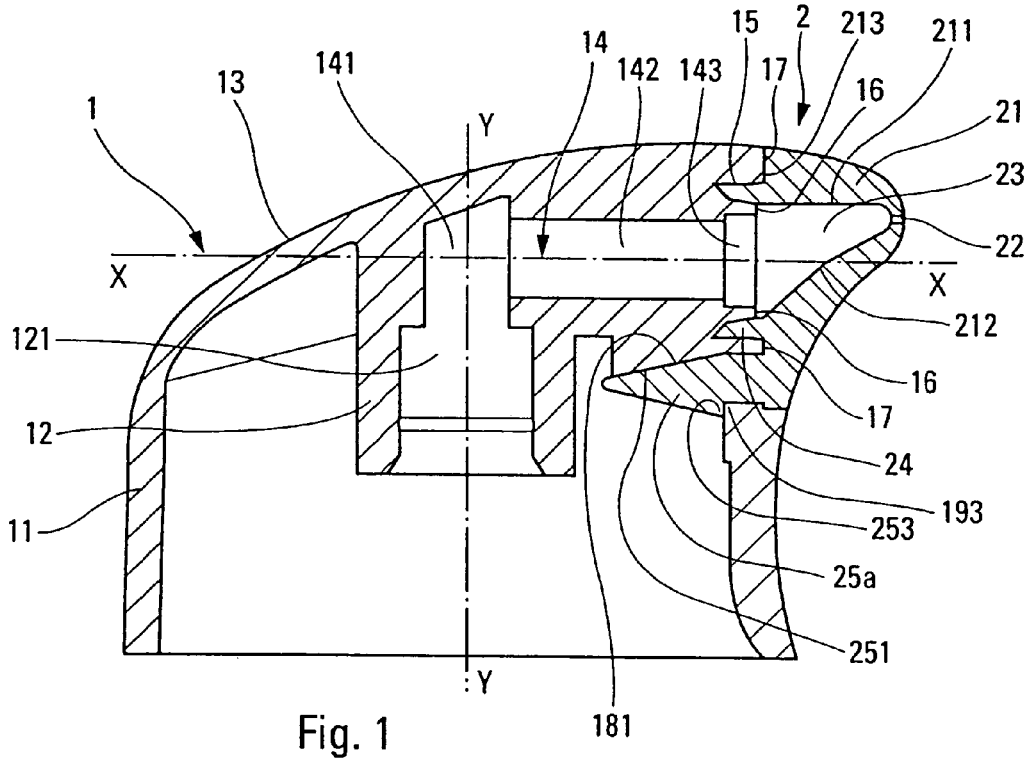
FIG. 1 is a vertical section view through a dispenser head of the invention.

The dispenser head used to illustrate the present invention and shown in the figures is a dispenser head of the pusher type that can be pressed using one or more fingers in order to actuate a dispenser member, such as a pump or a valve, to which the head is fitted. However, a dispenser head of the present invention may be dissociated from the pusher function and have merely a discharging and dispensing function for discharging and dispensing the fluid. In which case, the pusher is separate from the head.

In the embodiment shown in the figures, the dispenser head is made up of two component elements, namely a body 1 and a shutter 2. The two elements may be made by injecting plastics materials into appropriate molds. The body is preferably made of a plastics material that is harder or stiffer than the shutter. For example, the shutter may be made of elastomer.

The body 1, which is preferably integrally molded in one piece, comprises a push top wall 13 which serves a pusher surface against which one or more fingers of one hand can be applied and can exert a pressing force. In this example, the top wall 13 has a complex shape that is both rounded and inclined. This is an ergonomic shape for the position of a finger with the tip phalanx of the finger placed on the highest portion of the top wall 13. In addition, the body 1 forms a peripheral side skirt 11 which extends from the top wall 13 downwards; The skirt 11 has a configuration that is also complex, but that is substantially cylindrical. Where the top wall 13 is at its highest, the skirt 11 forms a join surface 17 that is exactly plane in this example. The join surface 17 is provided with plurality of openings or slots, as is described below. The shutter 2 is described below and is designed to be mounted on the body 1 at the join surface 17.

The body 1 internally defines a connection sleeve 12 serving to receive the top end of an actuating rod of a dispenser head such as a pump or a valve. The socket formed by the connection sleeve 12 may be of the force-fitting type or of the snap-fastening type. The rod-receiving socket is extended by a dispensing duct 14 which defines an axial inlet 141. This inlet is disposed on a vertical longitudinal axis Y which coincides with the axis of the dispenser member and of its actuating rod. Naturally, the inlet 141 is open facing downwards so as to communicate with the socket formed by the connection sleeve 12 in which the top end of the actuating rod is to be engaged. In many cases, the body 1, and more generally the dispenser head, is mounted to rotate about said vertical axis Y. The dispensing duct 14 also forms a radial passageway 142 which opens out at the join surface 17 via an outlet 143. The outlet 143 and the passageway 142 that connects the inlet 141 to the outlet 143 extend along a dispensing or outlet axis X. The outlet axis X extends substantially perpendicularly to the vertical longitudinal axis Y. However, the axis X may extend slightly or significantly upwards or downwards relative to the axis Y. The outlet 143 is thus flanked by a plane annular surface 16 which may be disposed in the same plane as the join surface 17, or advantageously be set back slightly inwards relative to said plane of the surface 17, as can be seen very clearly in FIG. 3. The annular wall 16 is surrounded externally by a groove 15 which extends from the join surface 17 into the body 1 in substantially the same direction as the outlet axis X. The groove 15 thus forms a sort of annular trench whose depth extends horizontally. The groove is made up of two concentric annular side walls 151 and 152 interconnected by an end wall 153.

Figure 2:
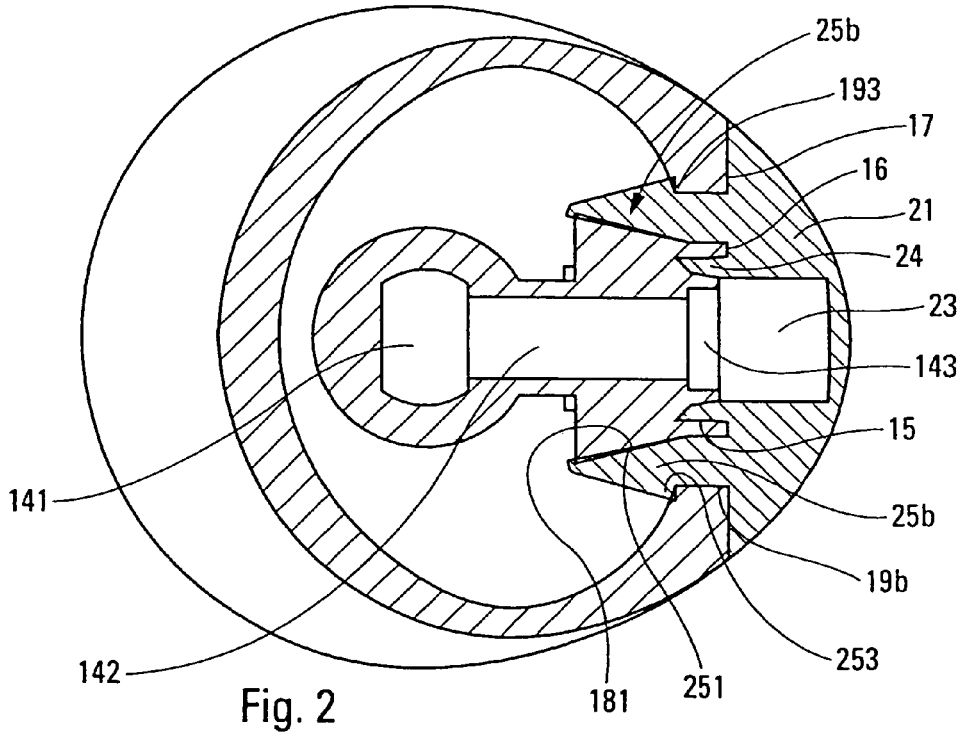
FIG. 2 is a horizontal section view on the outlet axis X of FIG. 1.
Figure 3:
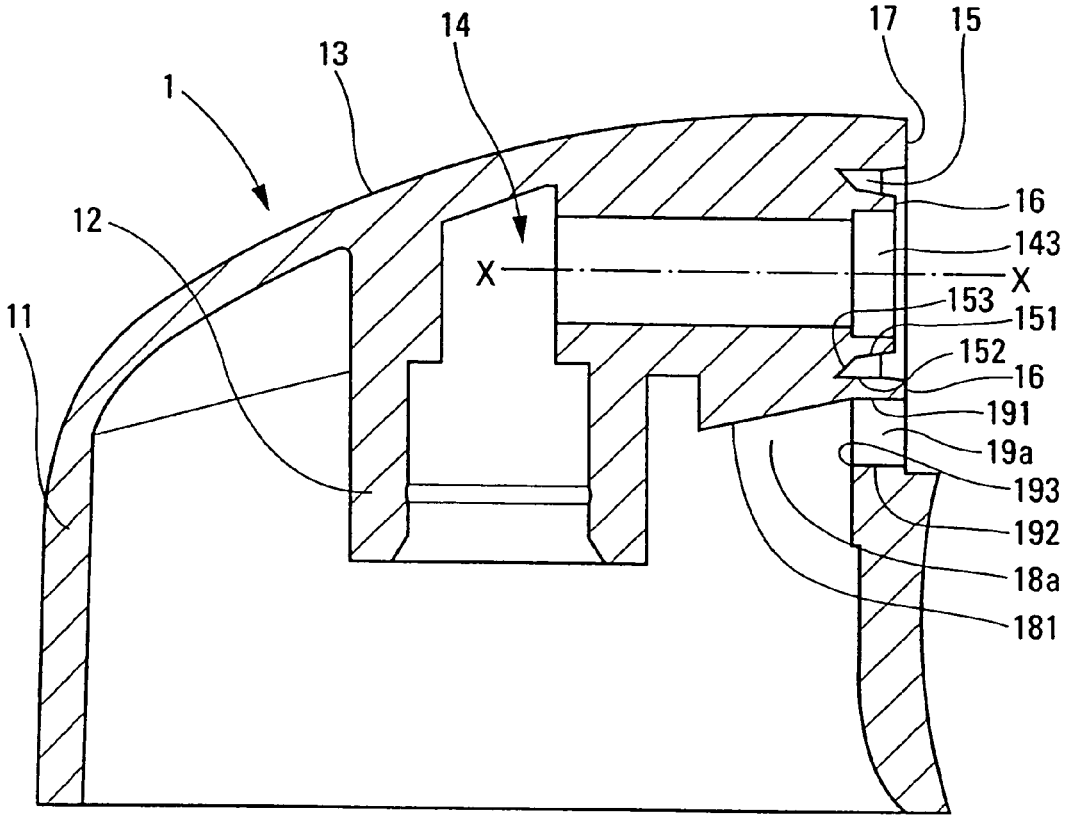
FIG. 3 is a vertical section view through the body of the dispenser head.
Figure 4:
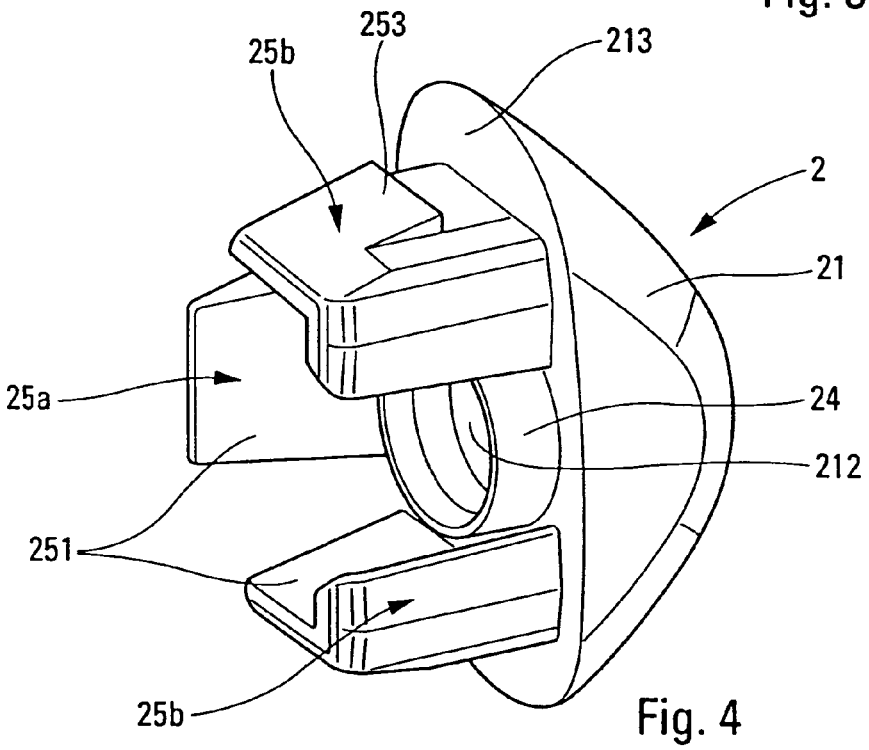
FIG. 4 is a perspective view of the shutter of the dispenser head of the invention.
Figure 6:
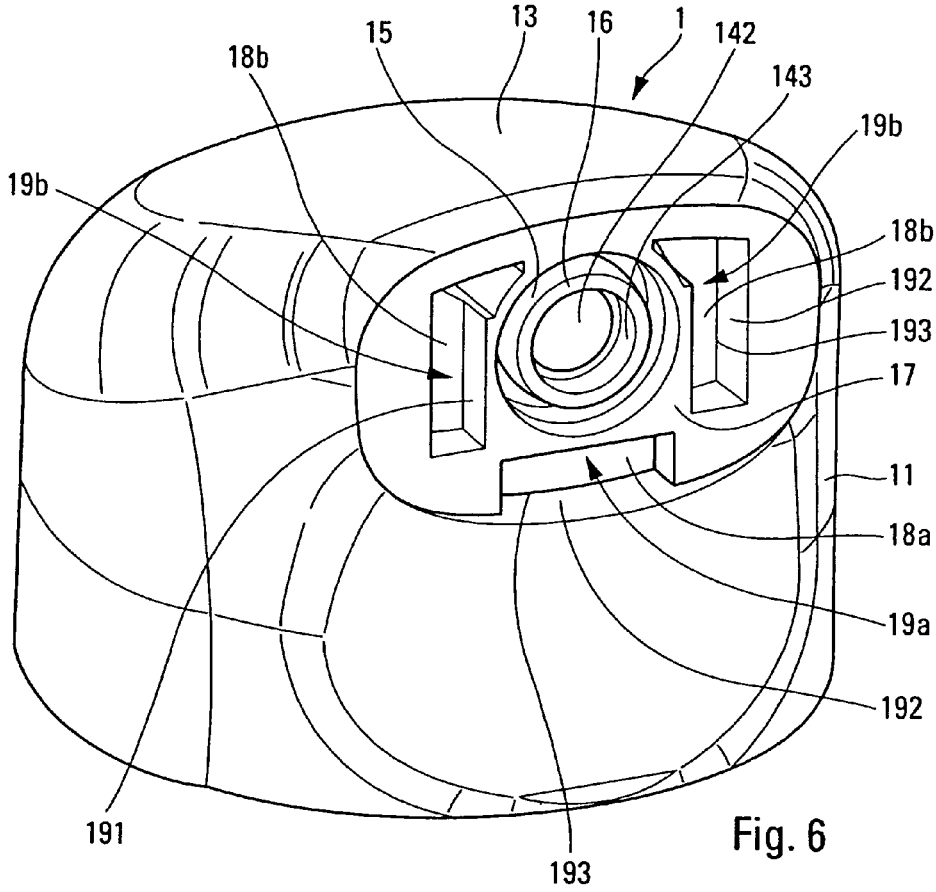
FIG. 6 is a perspective view of the body of the dispenser head of the invention.
Figure 5:
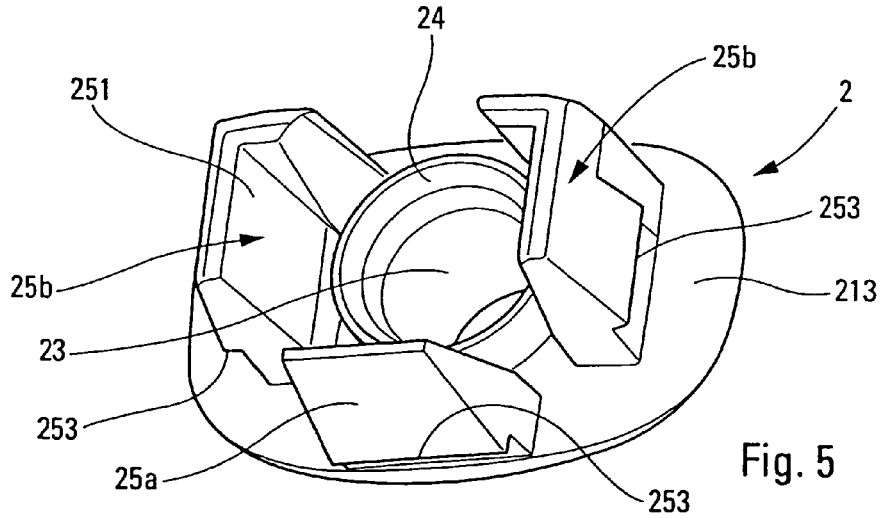
FIG. 5 is another view of the shutter seen from another angle.

The groove 15 is surrounded by the join surface 17. With reference to FIG. 6, it can be seen that the groove 15 is surrounded on at least three of its sides, namely its two lateral sides and its bottom side, by respective insertion windows, namely a bottom window 19*a* below the groove, and two side insertion windows 19*b*. The section view of FIG. 3 shows the insertion window 19*a*, whereas FIG. 2 shows the side windows 19*b*. The insertion windows 19*a* and 19*b* pass through the thickness of the wall of the skirt 11 so as to give access to the inside of the body 1. The insertion windows constitute openings giving access to holding recesses 18*a* and 18*b*. The window 19*a* gives access to the bottom recess 18*a* while the windows 19*b* give access to the side holding recesses 18*b*. Each window defines an inner edge 191 and an outer edge 192. The inner edge 192 is closer to the axis X than is the outer edge 192. The inner edges 191 are placed immediately outside the groove 15 while the outer edges 192 face the inner edges 192 with the access passageway extending between them. In the invention, the inside shoulder 193 formed by the outer edge 192 serves as a holding profile for co-operating with the shutter 2 as explained below. There are therefore three holding shoulders 193 that extend towards the axis X. Said shoulders constitute holding means that face inwards towards the axis X. Each of the inner edges 191 extends inside a respective one of the holding recesses while forming a respective locking surface 181 that faces outwards relative to the axis X and that forms an angle relative to the horizontal. Thus, by engaging a piece horizontally through one of the windows, said piece is caused rapidly to come into contact with said locking surface 181. The real function of said locking surface is described below.

It can thus be said that the outlet 143 is surrounded concentrically by a groove 15. As explained below, the function of said groove is to provide sealing with the shutter 2. It can also be noted that the holding recesses extend concentrically around the outlet 143 and around the groove 15. The groove 15 is separated from the insertion windows of the recesses by the join surface 17. This can be seen in FIG. 6. The join surface also advantageously extends around the insertion windows 19*a* and 19*b*.

The shutter 2 forms a dispensing spout 21 internally forming an outlet or dispensing chamber 23 having a wide opening flanked by a sealing lip 24. The chamber 23 extends from said sealing lip by forming a top surface 211 and a bottom surface 212. The two walls 211 and 212 converge towards each other until they meet at a self-closing slit 22 that forms a dispensing orifice. The self-closing slit has edges that are in touching leaktight contact in the rest position, i.e. whenever the chamber 23 does not contain any fluid subjected to a pressure higher than a threshold pressure making it possible to separate the edges of the slit and thus to open the dispensing orifice 22. In the embodiment shown in the figures, the bottom surface 212 is inclined upwards and thus constitutes a convergence wall suitable for directing the fluid under pressure towards the dispensing orifice. The sealing lip 24 is surrounded by a contact surface 213. Fixing catches 25*a* and 25*b* extend from said contact surface 213. In the non-limiting embodiment, there are a bottom catch 25*a* and two side catches 25*b*. The three catches extend from the contact surface 213 around the sealing lip 24. The catches and the lip 24 project from the contact surface 213, so that it can be said that the catches extend concentrically around the sealing lip 24. Each catch has an inside face facing the lip 24 and an outside face. In the invention, the outside faces of the catches form fixing means in the form of snap-fastening fixing profiles 253. More precisely, the fixing profiles 253 are formed by projecting ridges that face outwards. In addition, the inside faces of the catches form cam surfaces 251.

The shutter 2 is fitted to the body 1 by causing the catches 25A and 25*b* to penetrate into respective ones of the holding recesses 18*a* and 18*b* through the insertion windows 19*a* and 19*b*. More precisely, the catch 25*a* penetrates into the recess 18*a* through the window 19*a*, while the two side catches 25*b* penetrate into respective ones of the recesses 18*b* through the windows 19*b*. By continuing in this way to insert the catches into the respective recesses, the cam surfaces 251 are caused to come into sliding contact with the locking surfaces 181 formed by the body. Fitting the shutter 2 is continued, and the sealing lip 24 starts to penetrate into the groove 15. By continuing to fit the shutter 2 to the body 1, the sealing lip 24 is caused to be pressed into the groove 15 so as to come into leaktight contact with the two side walls 151 and 152 of said groove, and advantageously also with the end-wall 153 thereof. Leaktight contact is thus obtained at three points that have very good sealing quality, since the lip is in tight-fitting engagement between the two facing side walls 151 and 152. At the same time as the lip 24 is coming into its final sealing position in the groove 15, the fixing profiles 253 formed on the outside faces of the catches come into engagement behind the holding shoulders 193 formed in the respective insertion windows. The cam surfaces 253 are then urged strongly by the locking surfaces 181. The catches are thus deformed slightly outwards, which increases the quality of fixing between the fixing ridges and the holding shoulders. In addition, the locking surfaces 181 permanently and irreversibly fixing the shutter 2 to the body 1.

It can also be noted that the visible outside surface of the shutter 2 extends the push top wall 13 and the skirt 11 without forming any step in the outline, so that the shutter 2 is smoothly incorporated into the body 1. The shutter 2 is very difficult to grasp for the purpose of extracting it. In any event, it is impossible to extract because of the snap-fastening between the fixing ridges and the holding shoulders, which snap-fastening is locked by the cam surfaces in engagement with the locking surfaces.

By means of the invention, the means making it possible to provide sealing between the shutter and the body are separate or dissociated from the means making it possible to fix the shutter to the body. In addition, the fixing profiles on the shutter facing outwards relative to the sealing lip enables said shutter to be removed naturally from the mold merely by moving the component elements of the mold apart. Better quality is thus guaranteed for the fixing profiles.

The duct, the outlet, the lip and the groove may be circular, oblong, elliptical ovoids, or more generally of any annular shape.

What is claimed is:

1. A fluid dispenser head designed to be fitted to a fluid dispenser member, said head comprising:

a body (1) forming a dispensing duct (14) having an inlet (141) designed to be connected to the dispenser head, and an outlet (143) having an outlet axis X; and a shutter (2) fitted to the body (1) for the purpose of selectively closing off the dispensing duct (14) at its outlet (143), the shutter forming a dispensing orifice (22) that is closed in the absence of fluid under pressure in the dispensing duct, and that is opened in the presence of fluid in the dispensing duct at a pressure greater than an opening threshold pressure, said shutter being provided with sealing means (24) and with fixing means (25*a*, 25*b*) co-operating respectively with complementary seal-receiving means (15) and with complementary holding means (18*a*, 19*a*, 18*b*, 19*b*) formed by the body (1) for the purpose of fixing the shutter (2) to the body (1) in leaktight manner;

said fluid dispenser head being characterized in that the fixing means comprise at least one snap-fastening profile (253) facing radially outwards relative to the outlet axis X, and the holding means comprise at least one holding profile (193) facing radially inwards towards the outlet axis X, said snap-fastening profile coming in snap-fastening engagement with said holding profile.

2. A fluid dispenser head according to claim 1, in which the seal-receiving means (15) are situated radially closer to the outlet axis X than the holding means (193).

3. A fluid dispenser head according to claim 2, in which the seal-receiving means (15) and the holding means (193) extend substantially concentrically.

4. A fluid dispenser head according to claim 1, in which the seal-receiving means comprise a peripheral groove (15) which extends around the outlet (143), and the sealing means comprise a sealing lip (24) in leaktight engagement in the groove (15).

5. A fluid dispenser head according to claim 1, in which the fixing means comprise at least one fixing catch (25*a*, 25*b*) forming an outside fixing profile (253), and the holding means comprise at least one holding recess (18*a*, 18*b*) forming a holding profile (193) designed to come into fixing engagement with the fixing profile.

6. A fluid dispenser head according to claim 5, in which the holding means further comprise locking means (181)

designed to co-operate with the catches (25*a,* 25*b*) to lock the fixing profile (253) in engagement with the holding profile (193).

7. A fluid dispenser head according to claim 6, in which the holding recess forms a locking surface (181) designed to urge the fixing catch (25*a,* 25*b*) so as to push the fixing profile (253) against the holding profile (193).

8. A fluid dispenser head according to claim 7, in which the locking surface (181) faces radially outwards relative to the outlet axis X, the fixing catch forming a cam surface (251) radially facing towards the outlet axis, said cam surface being in engagement with the locking surface.

9. A fluid dispenser head according to claim 5, in which said at least one holding recess comprises an insertion window (19*a,* 19*b*) defining an inner edge (191) and an outer edge (192) relative to the outlet axis, said outer edge defining a snap-fastening inside shoulder (193) forming said holding profile, said outside fixing profile (253) coming into snap-fastened engagement with said snap-fastening inside shoulder (193).

10. A fluid dispenser head according to claim 1, in which the dispensing orifice (22) is a self-closing slit urged at rest into a leaktight closed position.

11. A fluid dispenser head according to claim 1, in which the dispensing duct (14) is integrally formed with the fixing means by the body.

12. A fluid dispenser head designed to be fitted to a fluid dispenser member, said head comprising:

a body forming a dispensing duct having an inlet designed to be connected to the dispenser head, and an outlet having an outlet axis X; and a shutter fitted to the body that selectively closes off the dispensing duct at its outlet, the shutter forming a dispensing orifice that is closed in the absence of fluid under pressure in the dispensing duct, and that is opened in the presence of fluid in the dispensing duct at a pressure greater than an opening threshold pressure, said shutter being provided with sealing member and with a fixing member co-operating respectively with complementary seal-receiving members and with complementary holding members formed by the body and that fixes the shutter to the body in leaktight manner;

wherein the fixing member comprises at least one fixing profile facing radially outwards relative to the outlet axis X, and the holding member comprises at least one holding profile facing radially inwards towards the outlet axis X;

wherein the seal-receiving member comprises a peripheral groove that extends around the outlet, and the sealing member comprises a sealing lip in leaktight engagement in the groove; and in which the groove forms two side walls interconnected by an end wall, the lip (24) being in leaktight contact at least with the two side walls.

13. A fluid dispenser head according to claim 12, in which said at least one fixing profile is a snap-fastening profile adapted to snap on a respective holding profile.

14. The fluid dispenser head according to claim 12, wherein the lip is in leaktight contact with the end wall.

15. A fluid dispenser head designed to be fitted to a fluid dispenser member, said head comprising:

a body forming a dispensing duct having an inlet designed to be connected to the dispenser head, and an outlet having an outlet axis X; and a shutter fitted to the body that selectively closes off the dispensing duct at its outlet, the shutter forming a dispensing orifice that is closed in the absence of fluid under pressure in the dispensing duct, and that is opened in the presence of fluid in the dispensing duct at a pressure greater than an opening threshold pressure, said shutter being provided with sealing member and with a fixing member co-operating respectively with complementary seal-receiving members and with complementary holding members formed by the body and that fixes the shutter to the body in leaktight manner;

wherein the fixing member comprises at least one fixing profile facing radially outwards relative to the outlet axis X, and the holding member comprises at least one holding profile facing radially inwards towards the outlet axis X;

wherein the seal-receiving member comprises a peripheral groove that extends around the outlet, and the sealing member comprises a sealing lip in leaktight engagement in the groove; and in which the lip flanks an outlet chamber situated in alignment with the outlet of the duct and having a convergence wall which extends towards the dispensing orifice and that directs the pressurized fluid coming from the outlet towards the dispensing orifice.

16. A fluid dispenser head designed to be fitted to a fluid dispenser member, said head comprising:

a body forming a dispensing duct having an inlet designed to be connected to the dispenser head, and an outlet having an outlet axis X; and a shutter fitted to the body that selectively closes off the dispensing duct at its outlet, the shutter forming a dispensing orifice that is closed in the absence of fluid under pressure in the dispensing duct, and that is opened in the presence of fluid in the dispensing duct at a pressure greater than an opening threshold pressure, said shutter being provided with sealing member and with a fixing member co-operating respectively with complementary seal-receiving members and with complementary holding members formed by the body and that fixes the shutter to the body in leaktight manner;

wherein the fixing member comprises at least one fixing profile facing radially outwards relative to the outlet axis X, and the holding member comprises at least one holding profile facing radially inwards towards the outlet axis X;

wherein the fixing member comprises at least one fixing catch forming an outside fixing profile, and the holding member comprises at least one holding recess forming a holding profile structured to come into fixing engagement with the fixing profile; and wherein the fluid dispenser further comprises three fixing catches disposed on either side of and below the outlet axis X, when the inlet faces downwards.

17. A fluid dispenser head designed to be fitted to a fluid dispenser member, said head comprising:

a body forming a dispensing duct having an inlet designed to be connected to the dispenser head, and an outlet having an outlet axis X; and a shutter fitted to the body for selectively closing off the dispensing duct at its outlet, the shutter forming a dispensing orifice that is closed in the absence of fluid under pressure in the dispensing duct, and that is opened in the presence of fluid in the dispensing duct at a pressure greater than an opening threshold pressure, said shutter being provided with a sealing member and with a fixing member co-operating respectively with a complementary seal-receiving member and with a complementary holding member formed by the body that fixes the shutter to the body in leaktight manner; and wherein the fixing member comprises at least one snap-fastening profile facing radially outwards relative to the outlet axis X, and the holding member comprises at least one holding profile facing radially inwards towards the outlet axis X, said snap-fastening profile coming in snap-fastening engagement with said holding profile.

* * * * *